United States Patent [19]

McCardle et al.

[11] Patent Number: 4,863,089

[45] Date of Patent: Sep. 5, 1989

[54] FLAGLESS NAIL DRIVING TOOL

[75] Inventors: Thomas A. McCardle; J. C. Taylor; Thomas E. Hentz, all of Cincinnati, Ohio

[73] Assignee: Senco Products, Inc., Cincinnati, Ohio

[21] Appl. No.: 272,220

[22] Filed: Nov. 16, 1988

[51] Int. Cl.[4] ..... B25C 1/04

[52] U.S. Cl. ..... 227/116; 227/136

[58] Field of Search ..... 227/116, 120, 136

[56] References Cited

U.S. PATENT DOCUMENTS

| | | | |
|---|---|---|---|
| 3,563,438 | 2/1971 | Doyle | 227/136 X |
| 3,628,715 | 12/1971 | Maynard | 227/136 |
| 3,920,169 | 11/1975 | DeCaro | 227/136 |
| 4,442,965 | 4/1984 | Leistner | 227/136 |

*Primary Examiner*—Frank T. Yost
*Assistant Examiner*—James L. Wolfe
*Attorney, Agent, or Firm*—Frost & Jacobs

[57] ABSTRACT

Improvements in the guide body and nail feed mechanism of a nail driving tool, using wire collated nails, to eliminate the formation of loose pieces of collating wire and the trapping thereof under the heads of driven nails to form flags. The tool has a driver, a magazine containing a coil of nails joined together in spaced relationship by collating wires welded to each nail, a guide body providing a drive track for the driver and the nails, and a feed pawl which advances and retracts in guideways in the guide body and has fingers engaging nails of the coil to locate the forwardmost nail thereof in the drive track. As the forwardmost nail of the coil is driven into a workpiece the collating wires break near the forwardmost nail leaving forwardly extending wire segments on the next succeeding nail. The drive track is provided with windows positioned to receive the wire segments of the forwardmost nail and bend them upwardly along the nail shank as the nail is driven. The feed pawl is provided with wide feed fingers to support the wire segments of the second nail of the coil, tending to assure breakage of the wires near the forwardmost nail and orienting the segments for receipt in the drive track windows. The pawl and the drive track are configured to prevent breakage or nicking of the segments of the second nail by the head of the forwardmost nail. The nails of the coil are spaced to assure wire segments of sufficient length.

12 Claims, 10 Drawing Sheets

FLAGLESS NAIL DRIVING TOOL

TECHNICAL FIELD

The invention relates to a nail driving tool utilizing coils of nails joined together in spaced, side-by-side relationship by collating wires welded to each nail, and more particularly to improvements in such a tool eliminating the formation of loose pieces of collating wire and the trapping thereof under the heads of driven nails.

BACKGROUND ART

Prior art workers have devised many types of nail driving tools wherein a nail is driven into a workpiece by a driver shiftable between a retracted position and a nail driving position. The teachings of the present invention are applicable to any such tool utilizing strips or coils of nails arranged in a spaced side-by-side row and connected together by carrier or collating wires which are welded to each nail. The strip or coil of wire collated nails is fed from a magazine such that the forwardmost nail of the row is located under the driver which advances to break the forwardmost nail from the strip or coil and drive it into a workpiece. Prior art workers have devised tools wherein the driver is actuated by pneumatic means, electromechanical means including flywheels, internal combustion means and the like.

While not intended to be so limited, for purposes of an exemplary showing the present invention will be described in its application to a pneumatically actuated tool. A pneumatically actuated tool is chosen for this purpose primarily because such tools constitute those most frequently encountered in the art. Examples of such tools are taught in U.S. Pat. No. 4,669,648 and in co-pending application Ser. No. 07/113,597, filed Oct. 26, 1987 in the names of Jay M. Steeves and Eric H. Halbert and entitled RESTRICTIVE TRIGGER ACTUATED VALVE ARRANGEMENT FOR A FASTENER DRIVING TOOL.

The use of wire collated strips or coils of nails is generally characterized by a problem. As each nail of the strip or coil becomes the forwardmost nail thereof, and is driven into a workpiece by the tool driver, the collating wires are broken at or near the forwardmost nail being driven. This leaves forwardly extending wire segments on the next succeeding nail, the wire segments extending outwardly from its shank. When the next succeeding nail advances beneath the driver and becomes the forwardmost nail of the strip or coil, the wire segments of this nail will hopefully remain attached to the nail and will be driven into the workpiece along with the nail. However, should the wire segments fail to remain attached to the nail, the resulting loose wire segments can become flying debris, or they can be trapped under the head of the driven nail. Such trapped wire segments are known in the art as "flags". Flags can snag, corrode, and are unsightly.

It will be understood by one skilled in the art that the quality of the welds of the collating wires to the nails is critical. If the collating wires simply become detached from the forwardmost nail as it is driven into the workpiece, experience has shown that occasional "stringers" of collating wire will be formed which cause several types of operating difficulties, including large flags. If the welds between the collating wires and the nails are weak, even in the practice of the present invention the welds may not be strong enough to pull the wire segments down into the workpiece. It is also possible to overweld, so as to weaken the wire near the weld. The actual welding process does not constitute a part of the present invention, and the disclosure to follow presumes adequate welding.

Experience has shown that most loose wire segments, when the welds are good, are created when the wire segments are broken from the nail as the nail enters the workpiece. It has been found that if the wire segments point down toward the point of the nail, it is very likely that the segments will be broken off when they hit the workpiece, particularly if the downwardly extending wire segments are located very close to the nail shank.

The present invention is based upon the discovery that with improvements to the guide body and drive track of the tool, and to the nail feed mechanism, the formation of loose pieces of collating wire and flags can be reduced significantly. Means are provided to assure that the collating wire segments of the nail to be driven are bent upwardly along the nail shank. The nails are adequately spaced along the collating wires to assure that the wire segments are of sufficient length to properly cooperate with the means that bends them upwardly along the nail shank. The feed mechanism is modified to provide support for the wire segments, to properly direct the wire segments to assure their cooperation with the means that bends them upwardly, and to assure that the collating wires break at or near the forwardmost nail of the row or coil.

Another problem encountered in the use of wire collated nail strips or coils is encountered if the head of the forwardmost nail being driven strikes the wire segments from which it has just been separated. The head may sever a piece of the segment or nick it. If a portion of a wire segment is severed, the severed portion becomes a loose piece of wire and the remainder of the segment still attached to the next succeeding nail is too short to cooperate with the segment bending means of the present invention. If the head of the forwardmost driven nail nicks the segment still attached to the next succeeding nail, that segment may not have sufficient strength to undergo the upward bending, or the entrance of the segment into the workpiece, without breaking. As a consequence, the present invention contemplates modification of the feed mechanism to prevent the head of the forwardmost nail being driven from striking the wire segment from which it has just broken away.

DISCLOSURE OF THE INVENTION

According to the invention there are provided improvements in the guide body and nail feed mechanism of a nail driving tool, using wire collated nails, to eliminate the formation of loose pieces of collating wire and the trapping thereof under the heads of driven nails to form unwanted and unsightly flags. The nail driving tool is characterized by a driver, a magazine containing a strip or coil of nails joined together in spaced, side-by-side relationship by collating wires welded to each nail, a guide body providing a drive track for the driver and the nails, and a feed pawl which advances and retracts through a fixed feed stroke in guideways in the guide body. The feed pawl has fingers which extend through the strip or coil of nails, engaging the second nail thereof. The feed pawl advances and locates the forwardmost nail of the strip or coil in the drive track of the tool.

As the forwardmost nail of the strip or coil is driven into a workpiece by the tool driver, the collating wires break near the forwardmost nail (i.e., just behind the weld thereon). This leaves forwardly extending wire segments on the next succeeding nail. Once the forwardmost nail is driven into the workpiece, the next succeeding nail becomes the forwardmost nail of the strip or coil. When it is inserted into the drive track by the feed pawl, the forwardly extending wire segments attached to it are received within windows formed in the drive track and so positioned as to bend the wire segments upwardly along the nail shank during the nail driving procedure. When the forwardmost nail of the strip or coil has been driven, along with its wire segments, into the workpiece, the feed pawl, which is pivotally mounted, shifts over the next succeeding nail (now the forwardmost nail of the strip or coil) and engages the next nail therebehind. At this point, the feeding cycle can be repeated.

The feed fingers of the feed pawl are made sufficiently wide to support the wire segments of the second nail of the strip or coil, tending to assure breakage of the wires near the forwardmost nail, and properly orienting the segments attached to the second nail for receipt in the drive track windows, when the second nail becomes the forwardmost nail and is advanced into the drive track. The feed pawl and the drive track are configured to prevent breakage or nicking of the segments of the second nail by the head of the forwardmost nail. Finally, the spacing of the nails on the carrier or collating wires and the travel of the feed pawl are so designed as to assure that the wire segments will be of such length as to properly enter the bend, in the drive track.

DETAILED DESCRIPTION OF THE INVENTION

Figure 1:
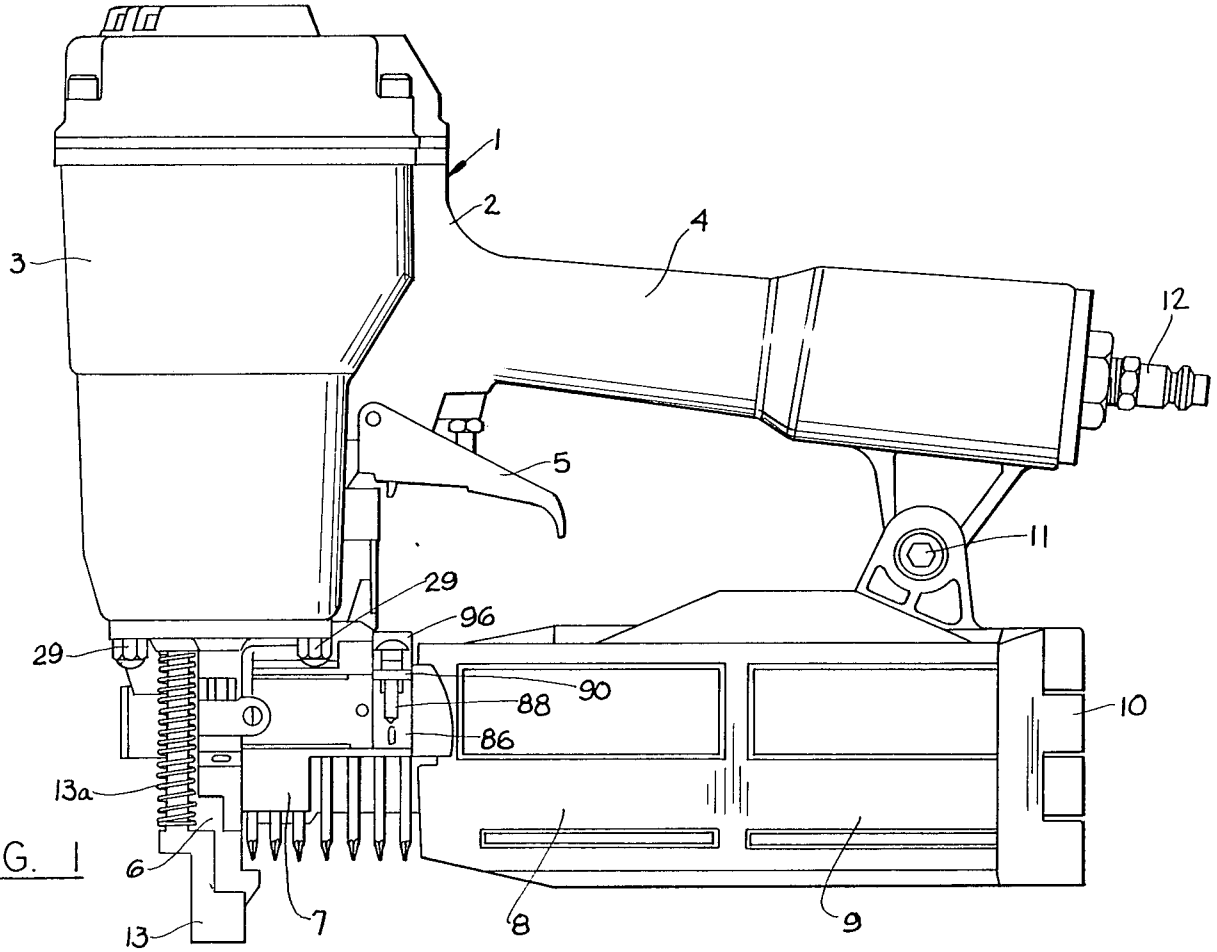
FIG. 1 is an elevational view of an exemplary pneumatic fastener driving tool incorporating the teachings of the present invention.

FIG. 1 illustrates an exemplary pneumatic nail driving tool to which the teachings of the present invention may be applied. The tool is generally indicated at 1. The tool has a body 2 comprising a main body portion 3 and a handle portion 4. As will be understood by one skilled in the art, the main body portion 3 contains a cylinder, a piston/driver assembly within the cylinder, a main valve for operating the piston/driver assembly at the top of the cylinder, and a remote valve for operating the main valve. The remote valve is actuated by manual trigger 5. The cylinder, piston/driver assembly, main valve and remote valve are not shown in FIG. 1. These elements are well-known in the art and do not constitute a part of the present invention.

Affixed to the lower end of the main body portion 3 there is a guide body 6. As will be described hereinafter, the guide body 6 defines a drive track for the driver of the piston/driver assembly and also mounts the feed mechanism for the coil of wire collated nails. The guide body 6 is provided with a door 7 which is openable to enable engagement of the forward end of the nail coil with the nail feed mechanism.

Affixed at its forward end to the guide body 6, there is a magazine 8 adapted to contain a wire collated coil of nails. Approximately one half of the magazine, indicated at 9, is hinged as at 10 and is swingable between a closed position as shown in FIG. 1 and an open position, whereby a coil of nails can be located in magazine 8. The rearward end of magazine 8 is bolted, as at 11, to the rearward end of handle 4.

The tool 1 is provided with a fitting 12 by which it can be connected to a flexible conduit or hose (not shown) leading to a source of air under pressure. Slidably mounted for vertical movement on guide body 6 is a workpiece responsive safety 13 constituting a safety device as is known in the art. The workpiece responsive safety 13 is biased to its lowermost extended position by a compression spring 13*a*. The tool will drive a nail into a workpiece when both the workpiece responsive safety 13 and the manual trigger 5 are shifted to their actuated positions. In some tools, it makes no difference which of the workpiece responsive safety and the manual trigger is actuated first. In a restrictive trigger-type tool, the workpiece responsive safety must first be actuated, followed by actuation of the manual trigger, in order to drive a nail into a workpiece.

Figure 2:
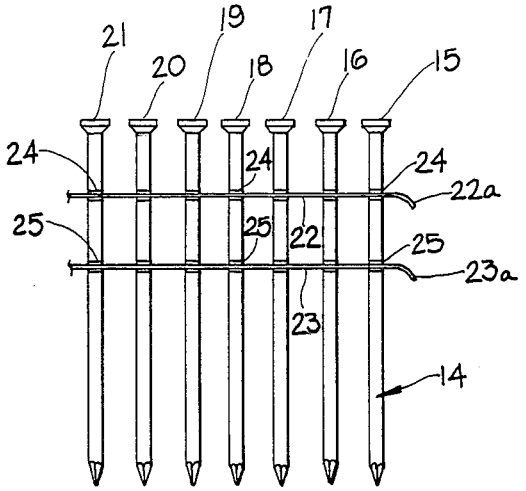
FIG. 2 is a fragmentary elevational view of a portion of a wire collated strip or coil of nails.

Reference is now made to FIG. 2 wherein a portion of a wire collated coil of nails is illustrated and generally indicated at 14. It will be understood that the total length of the coil of nails 14 will depend upon the capacity of magazine 8. In FIG. 2, seven nails 15 through 21 are illustrated. It will also be understood that these nails constitute but a fraction of the total number of nails in a full coil thereof. Nails 15 through 21 are arranged in a spaced, side-by-side row and are connected together by a pair of carrier or collating wires 22 and 23. The collating wires 22 and 23 are welded to each nail as at 24 and 25, respectively. As indicated above, this disclosure presumes that the welds 24 and 25 have been properly and adequately executed.

As was also indicated above, when the forwardmost nail 15 of the coil 14 is driven into a workpiece by the driver of tool 1, the collating wires 22 and 23, extending between nail 15 and nail 16, will break behind the welds 24 and 25 on nail 15. The segments of wires 22 and 23 between nails 15 and 16 will remain attached to nail 16. To illustrate this, nail 15 is shown as having wire segments **22*a* and 23*a* attached to it, assuming that a nail (not shown) ahead of nail 15 has previously been driven into a workpiece. It will be noted that wire segments 22*a* and 23*a* extend forwardly of nail 15** and are bent somewhat downwardly with respect thereto.

Figure 3:
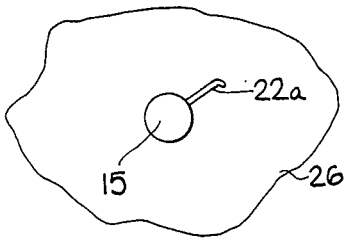
FIG. 3 is a fragmentary plan view of a workpiece with a nail driven therein and having a flag.
Figure 12:
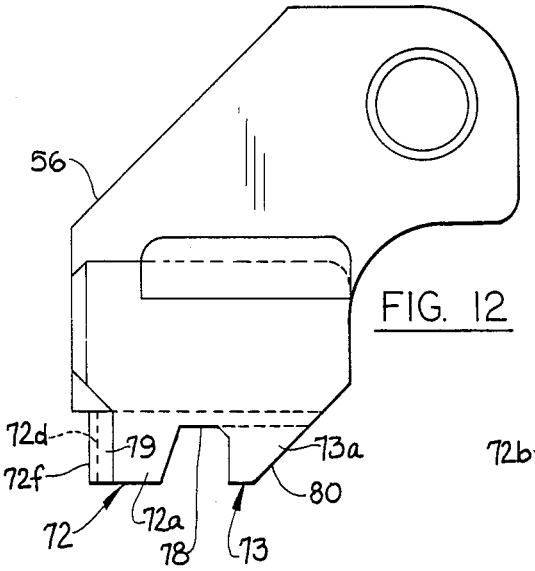
FIG. 12 is an end elevational view of the feed pawl as seen from the top of FIG. 9.
Figure 13:
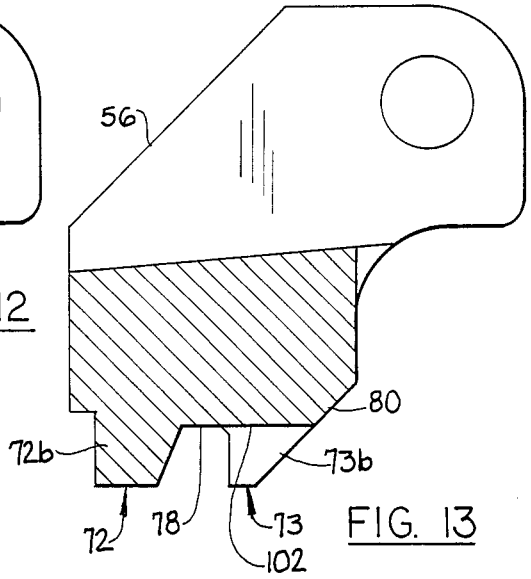
FIG. 13 is a cross sectional view taken along section line 13—13 of FIG. 9.

It is with wire segments such as segments **22*a* and 23*a* that the present invention is concerned. It is important that these segments remain attached to nail 15 and that they are driven into the workpiece along with the shank of nail 15. Should they break before they are driven into the workpiece, they will become flying debris, or they can be trapped under the head of nail 15 when driven into a workpiece. This is shown in FIG. 3, wherein a fragmentary plan view of a workpiece 26 is shown. For purposes of explanation, let it be assumed that segment 22*a* was broken from nail 15 and was trapped under the head of nail 15 which is shown driven into workpiece 26. It will be immediately apparent from FIG. 3 that wire segment 22*a* has become what is referred to in the art as a "flag". The flag 22*a* of FIG. 3 constitutes a snag. Further, the flag 22*a*** is subject to corrosion and is unsightly.

The guide body 6 of the present invention is substantially conventional, but has certain modifications which will be pointed out hereinafter. The guide body 6 is best shown in FIGS. 4 through 8 wherein like parts have been given like index numerals. The guide body 6 comprises an upper substantially rectangular plate-like structure 27, best seen in FIG. 8. The plate-like structure 27 is provided with four perforations 28 near its corners for the receipt of bolts by which the guide body 6 is affixed to the main body portion 3 of tool 1. Two such bolts are illustrated at 29 in FIG. 1. Depending vertically downwardly from the plate-like structure 27, when the tool is in the position shown in FIG. 1, the guide body 6 has a substantially cylindrical body portion 30 which defines a cylindrical drive track 31 (see in particular FIG. 7). Extending rearwardly from the cylindrical body portion 30 of guide body 6, and downwardly from the plate-like structure 27, there is a vertical wall element 32. It will be understood by one skilled in the art that the guide body 6 constitutes an integral, one-piece casting.

With respect to the cylindrical portion 30 of the guide body, it will be appreciated that the forwardmost nail of the coil, when introduced into drive track 31, will be suspended there by the collating wires of the coil. If, for any reason, the forwardmost nail is not properly centered in drive track 31 (for example, if the spacing of certain of the nails along the collating wires is slightly off), the upper end of the drive track 31 is provided with a lead-in surface 33. The lead-in surface 33 slopes downwardly and forwardly and is adapted to cooperate with the head of the forwardmost nail to properly center it in drive track 31. If, during the driving procedure, the forwardmost nail becomes skewed and its pointed end angles rearwardly, the lower end of the cylindrical member 30 is provided with a transverse web 34, the inside surface 35 of which slopes downwardly and forwardly to prevent back- driving of the nail.

The cylindrical portion 30 of guide body 6 differs from the prior art primarily in two respects. First of all, the forwardly facing part of cylindrical portion 30 is provided with a pair of openings or windows 36 and 37. The windows 36 and 37 are most clearly seen in FIGS. 4 and 7. The windows 36 and 37 are substantially rectangular, with their long axis parallel to the axis of drive track 31, so that they are oriented substantially vertically, when the tool is maintained in the position shown in FIG. 1. Windows 36 and 37 are so sized and positioned as to receive the wire segments of the forwardmost nail, when the forwardmost nail is located in drive track 31.

Figure 4:
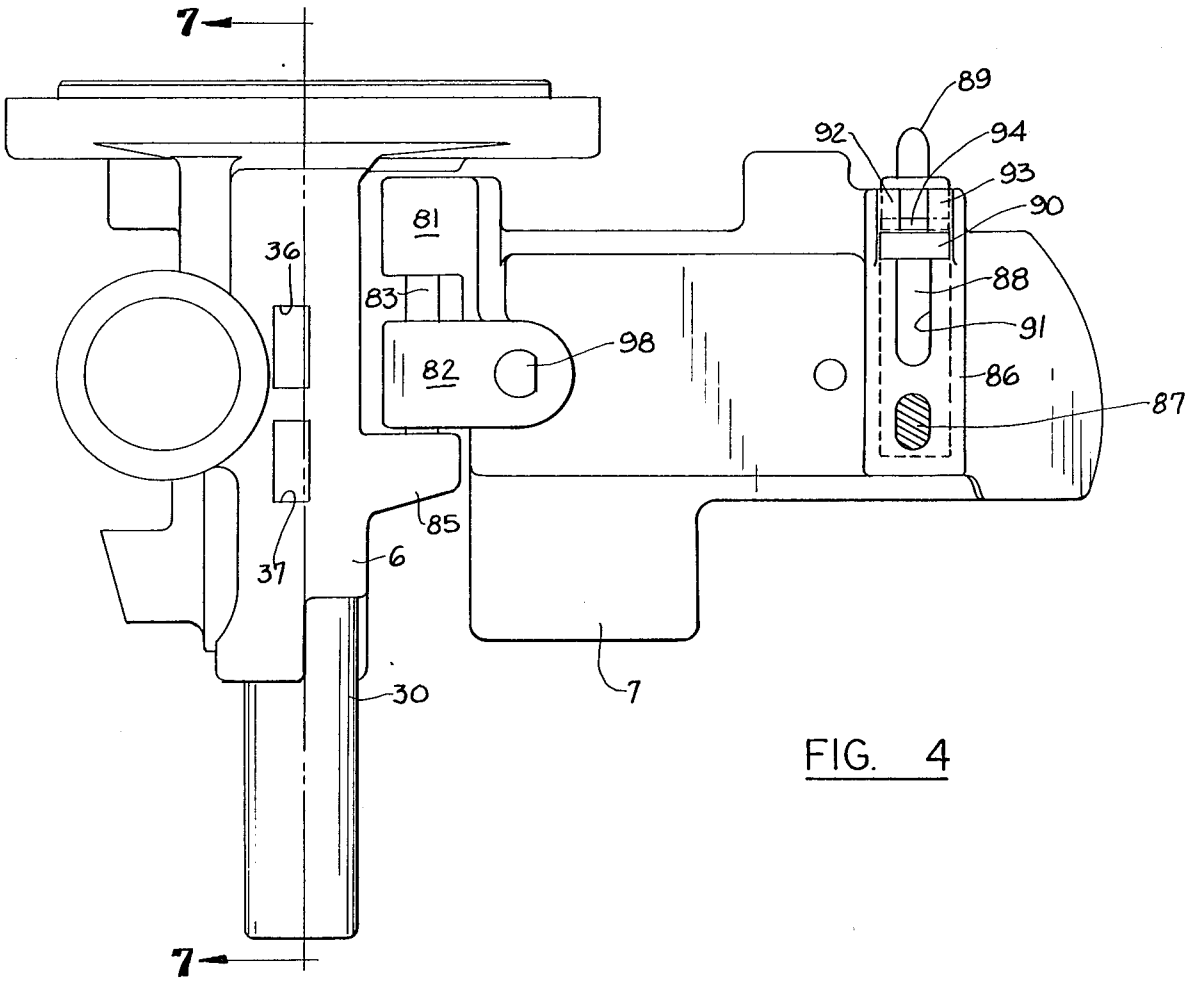
FIG. 4 is a front elevational view of the guide body with the guide body door in open position.

In FIG. 4, section line 7—7 lies along the vertical center line of guide body 6. It will be noted that windows 36 and 37 lie to one side of the center line. This is true because the collating wires 22 and 23 of nail coil 14 lie to the same side of the nail shanks. As will be described hereinafter windows 36 and 37 serve to fold the wire segments of the forwardmost nail upwardly along the shank of the forwardmost nail during the initial part of the nail driving procedure.

Figure 5:
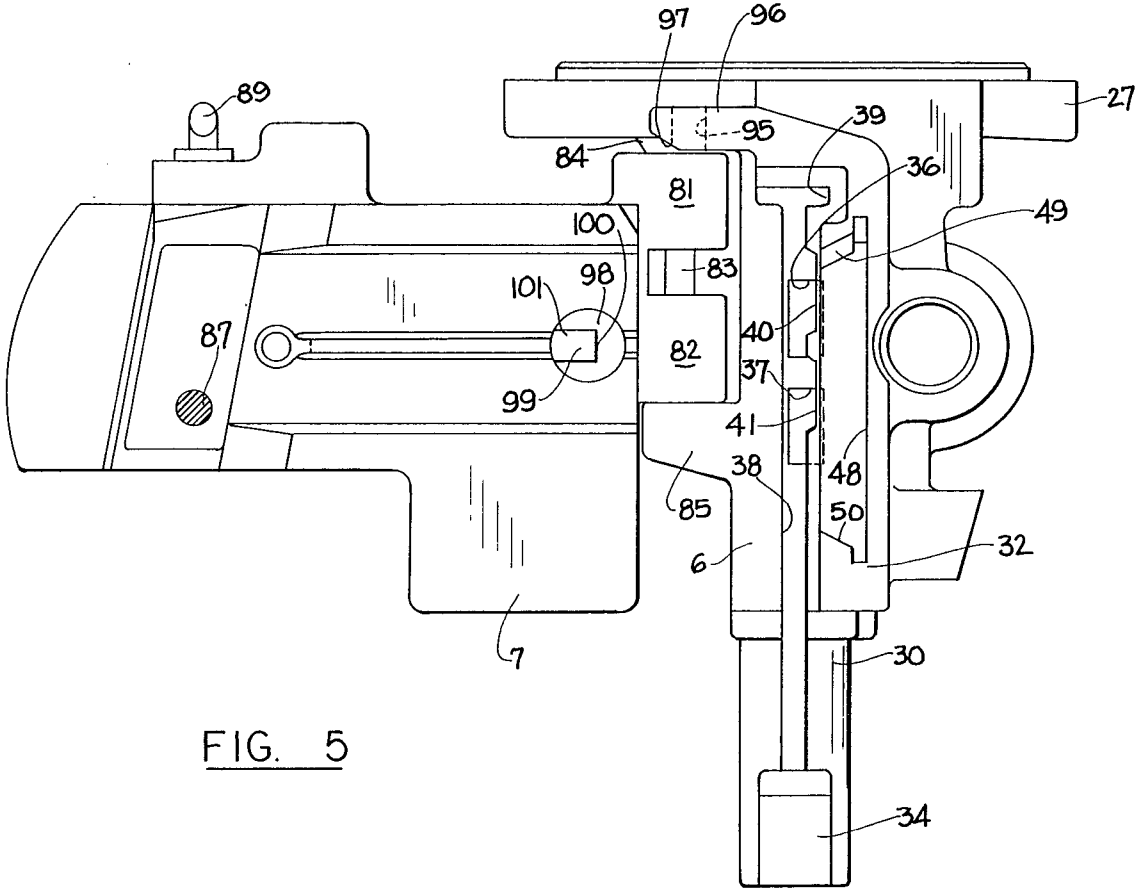
FIG. 5 is a rear elevational view of the guide body with the guide body door in open position.

The second change in the cylindrical portion 30 of guide body 6 is most easily seen in FIG. 5. That part of the cylindrical portion 30 which faces rearwardly is provided with a longitudinal slot 38 through which the forwardmost nail of the coil enters drive track 31. At its upper end, the slot 38 is enlarged as at 39 so as to accommodate the head of the forwardmost nail.

According to the present invention, the slot 38, except for the portion 39, has been narrowed considerably, as compared to similar slots in similar prior art guide bodies. With the exception of the notches 40 and 41 in the right side of slot 38 (as viewed in FIG. 5), the slot is of a width to just nicely receive the shank of the forwardmost nail and is of a width less than the diameter of the nailhead. This tends to keep the nail centered in drive track 31 and tends to prevent the nailhead from shifting rearwardly with respect to the drive track.

Figure 6:
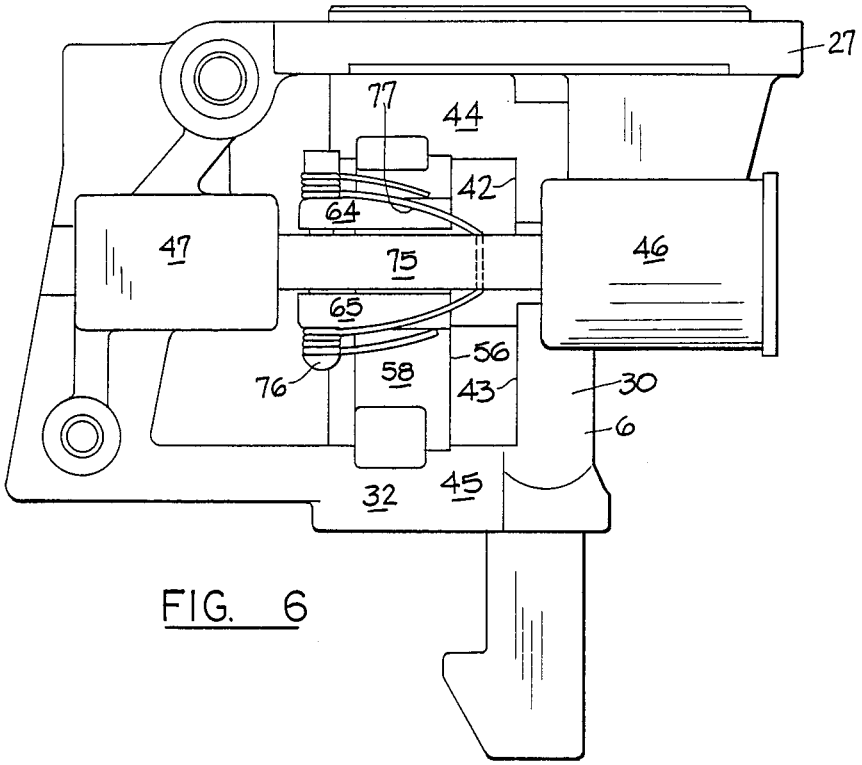
FIG. 6 is a right side elevational view of the guide body.

The exterior surface of the wall portion 32 of guide body 6 is illustrated in FIG. 6. The wall 32 has a pair of rectangular windows 42 and 43 formed therein. The rectangular windows 42 and 43 are adapted to receive the fingers of the feed pawl, as will be described hereinafter. The long axes of wall windows 42 and 43 are horizontal, as viewed in FIG. 6. The surface 44 above window 42 and the surface 45 below window 43, as viewed in FIG. 6, are coplanar. Finally, a pair of cylinders 46 and 47 are integrally formed on the guide body 6, as shown in FIG. 6. The purpose of cylinders 46 and 47 will be apparent hereinafter.

Figure 7:
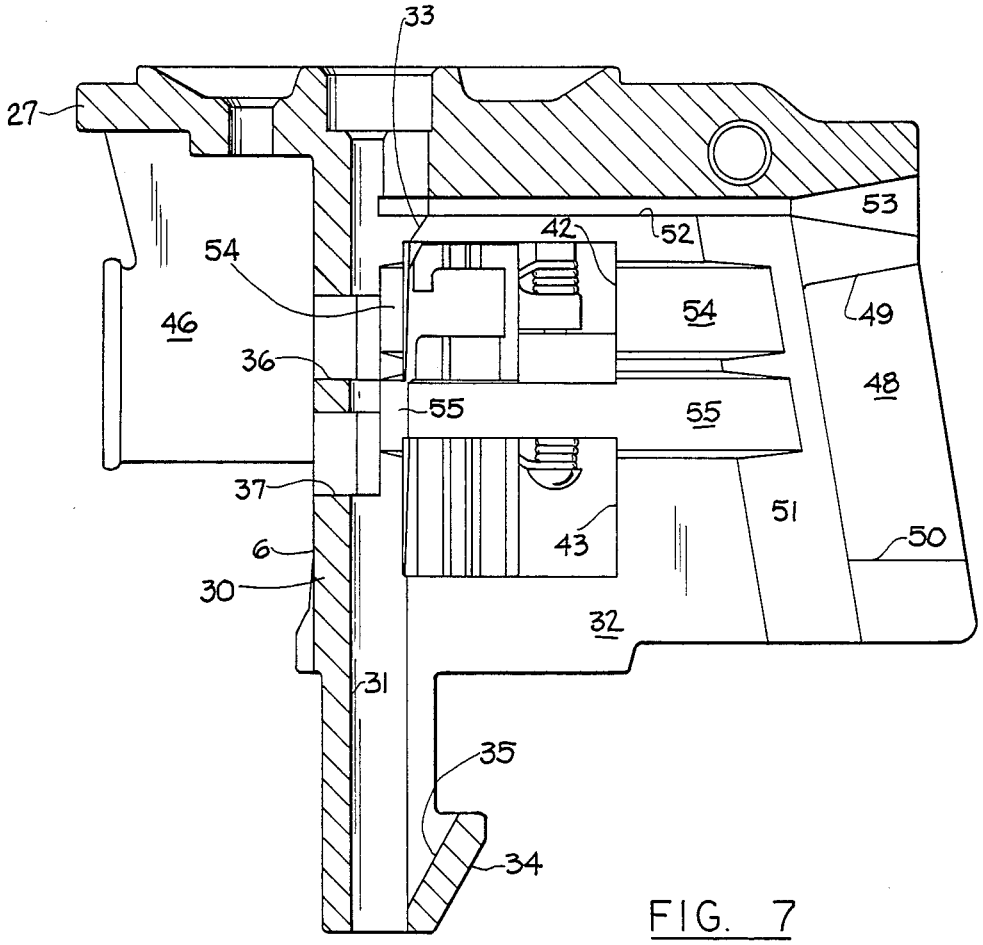
FIG. 7 is a cross sectional view of the guide body, taken along line 7—7 of FIG. 4.
Figure 8:
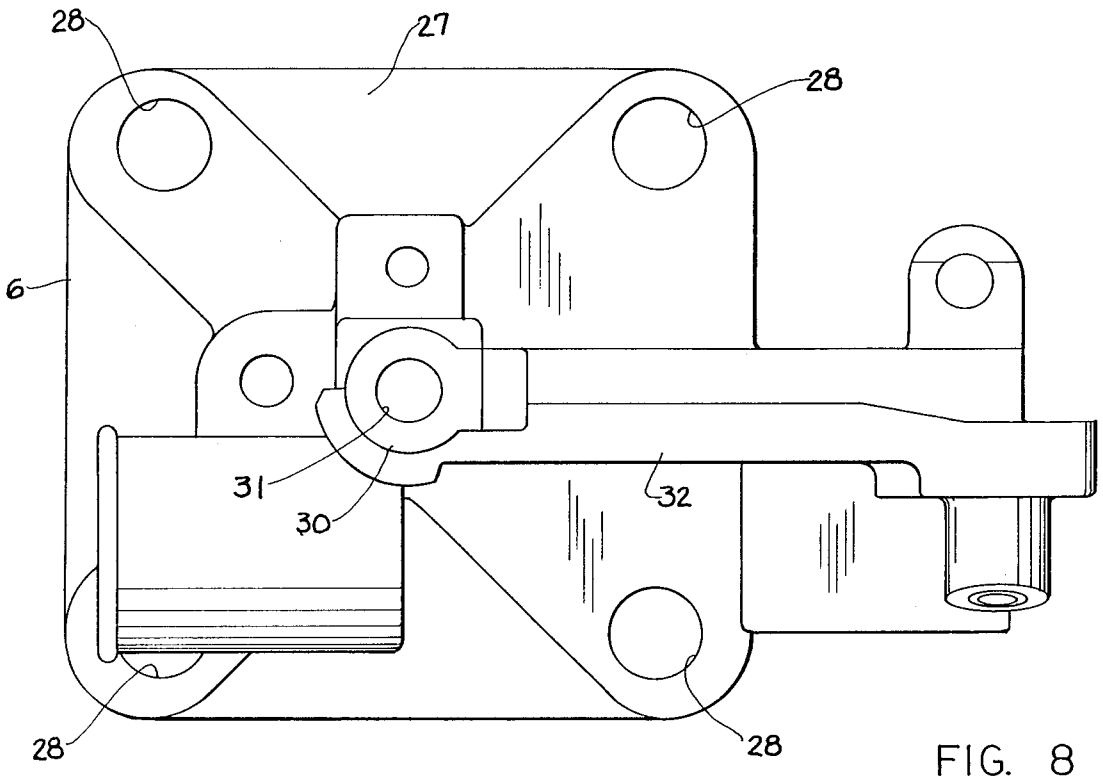
FIG. 8 ia a bottom view of the guide body of the present invention.
Figure 11:
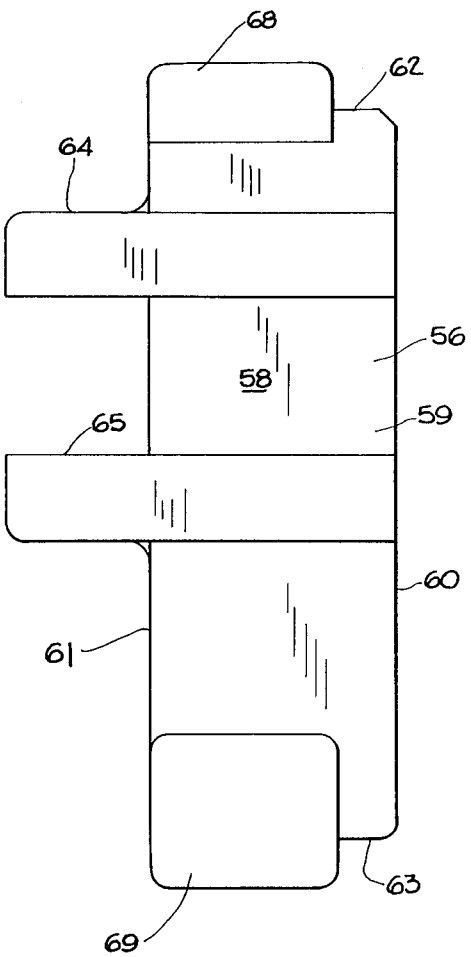
FIG. 11 is an elevational view of the feed pawl illustrating that side thereof opposite the side illustrated in FIG. 9.
Figure 9:
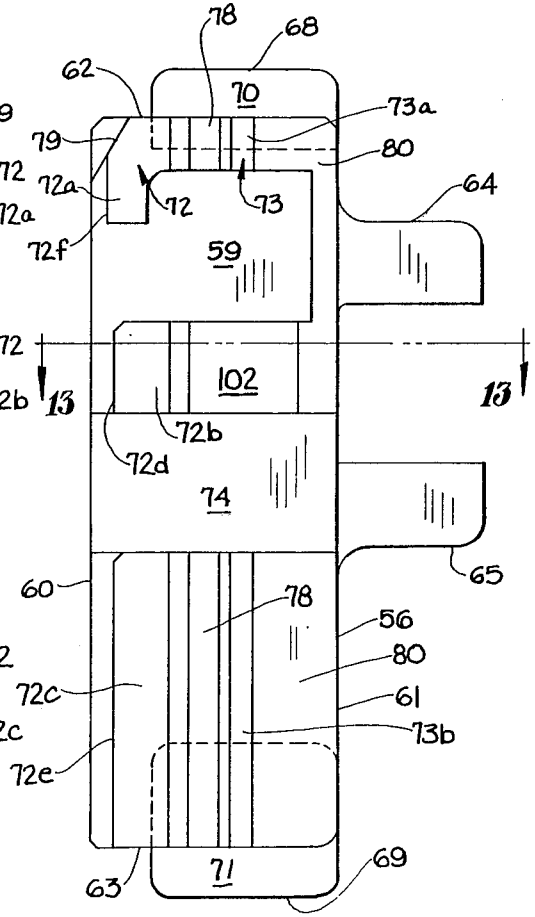
Fig 9 is an elevational view of the feed pawl, illustrating that side thereof having the feed fingers.
Figure 10:
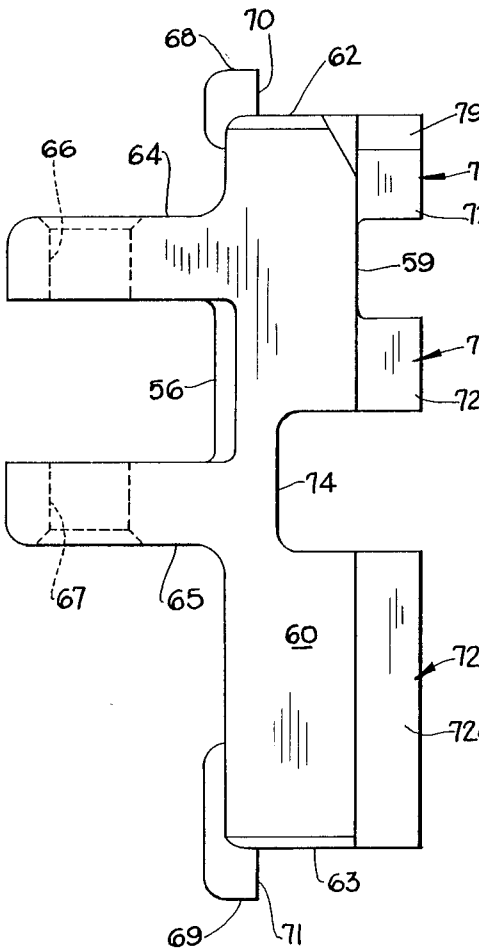
FIG. 10 is an end elevational view of the feed pawl, as seen from the left of FIG. 9.

The interior surface of wall 32 is illustrated in FIG. 7. At its rearwardmost end, the wall 32 is provided with a slot 48 having overhanging flanges 49 and 50 (see also FIG. 5). The flanged slot 48 is adapted to receive and rigidly hold the forwardmost end of the fixed portion of magazine 8. In this way, the forward end of magazine 8 is affixed to guide body 6. Near slot 48, the inside surface of wall 32 is provided with an inwardly sloping lead-in surface 51 which helps to guide the wire collated nail coil into the feed mechanism to be described hereinafter. Along its upper edge, the wall portion 32 of guide body 6 has a slot 52 with a lead-in portion 53. The slot 52 is adapted to accommodate the heads of the nails of the coil. It will be noted from FIG. 7 that the slot 52 extends into and blends with the upper end of drive track 31.

The inside surface of wall 32 is provided with a pair of shallow slots 54 and 55 which extend from the lead-in surface 51 into the drive track 31, intersecting windows 42 and 43. The shallow slots 54 and 55 correspond to the notches 40 and 41 in the cylindrical portion 30 of the guide body 6 (see FIG. 5) and accommodate the collating wires 22 and 23 on the nail coil 14.

The present invention contemplates the spacing of the nails along the collating wires 22 and 23 by distance sufficient to assure that the wire segments 22*a* and 23*a* of the forwardmost nail 15 will enter bending windows 36 and 37. The invention also contemplates widening of the feed pawl fingers, as will be described hereinafter. As a consequence of this, the primary difference between the wall portion 32 of the guide body 6 of the present invention and the similar wall portion of a similar prior art guide body is the elongation of windows 42 and 43 to accommodate a longer stroke of the feed pawl, next to be described.

The feed pawl is best shown in FIGS. 9 through 13. The feed pawl is basically conventional, with certain important modifications which will be outlined hereinafter.

Feed pawl 56 has a substantially block-like, rectangular body 57 with an outside surface 58, an inside surface 59, a forward edge 60, a rearward edge 61, an upper end 62 and a lower end 63. The outer surface 58 has extending therefrom a pair of lugs 64 and 65 having coaxial perforations 66 and 67, respectively, extending therethrough. The outer surface 58 also has, near the pawl ends 62 and 63, a pair of laterally extending lugs 68 and 69, respectively. The laterally extending lugs 68 and 69 have bearing surfaces 70 and 71, respectively. The purpose of bearing surfaces 70 and 71 will be apparent hereinafter.

The inner surface 59 of feed pawl 56 carries a pair of discontinuous, longitudinally extending fingers, generally indicated at 72 and 73. The inner surface 59 also has a transverse notch 74 formed therein. The purpose of notch 74 will be apparent.

Reference is now made to FIG. 6, showing the right side elevation of guide body 6. The cylinders 46 and 47 are each provided with a piston (not shown). The pistons of cylinders 46 and 47 share a common piston rod 75. The feed pawl 56 is located between piston rod 75 and the wall portion 32 of guide body 6, with its discontinuous fingers 72 and 73 extending through windows 42 and 43. That part of guide body wall portion 32 which extends between windows 42 and 43 is received in the notch 74 in feed pawl 56.

As is apparent from FIG. 6, the piston rod 75 extends between the lugs 64 and 65 of feed pawl 56. A bolt 76 passes through pawl perforations 66 and 67 and a coaxial perforation (not shown) in piston rod 75. In this way, feed pawl 56 is pivotally mounted to piston rod 75.

A torsion spring 77 has coiled portions mounted on bolt 76 adjacent the outside surfaces of feed pawl lugs 64 and 65. The free ends of torsion spring 77 bear against the upper surface 58 of feed pawl 56. The central portion of torsion spring 77 loops beneath piston rod 75. Torsion spring 77 serves to bias the pivoted feed pawl 56 to the position shown in FIG. 6 wherein its discontinuous fingers 72 and 73 extend through the guide body windows 42 and 43. When the feed pawl 56 is in this biased position, the bearing surfaces 70 and 71 of the feed pawl lateral flanges 68 and 69 bear against and slide along the wall surface portions 44 and 45 of guide body 6. Through the agency of piston rod 75, feed pawl 56 is shiftable to a forward position by cylinder 47 and is shiftable to a rearward or retracted position by cylinder 46. As will be apparent hereinafter, when the feed pawl 56 is in its forwardmost position, it has advanced the forwardmost nail of the coil 14 into drive track 31. To accomplish this, the feed fingers 72 and 73 of feed pawl 56 lie to either side of and engage the second nail of coil 14. When the forwardmost nail has been driven by the driver of tool 1, the second nail of the coil becomes the forwardmost nail. When cylinder 46 causes feed pawl 56 to shift to its rearward or retracted position, the feed fingers 72 and 73 pivot out of the way of and then engage what has just become the second nail of coil 14, ready to advance the new forwardmost nail of coil 14 into drive track 31.

Referring specifically to FIGS. 9, 10, 12 and 13, feed finger 72 extends the length of the body portion of feed pawl 56 and is discontinuous, being made up of segments 72*a*, 72*b* and 72*c*. Feed finger 73 similarly extends along the length of the body portion of feed pawl 56 and is made up of two segments, 73*a* and 73*b*. As can be most clearly understood from FIGS. 12 and 13, the feed fingers 72 and 73 define between them a discontinuous notch 78 adapted to receive and engage the second nail of coil 14.

The primary difference between the feed pawl 56 of the present invention and similar feed pawls of the prior art lies in the configuration of feed fingers 72 and 73. With respect to the feed pawl 56 of the present invention, feed fingers 72 and 73 have been made wider in a transverse sense (i.e. from left to right as viewed in FIGS. 9, 12 and 13). This enables feed finger segment 72*b* to more fully support collating wire 22 and enables feed finger segments 72*c* and 73*b* to more fully support collating wire 23 between the first and second nails of the coil. This has several effects. First of all, it tends to assure that the collating wires 22 and 23 will break adjacent the forwardmost nail. Furthermore, it will assure that collating wire segments 22*a* and 23*a* (see FIG. 2) will be properly directed for entrance into bending windows 36 and 37.

A second modification to feed pawl 56 constitutes the provision of a chamfer 79 on the uppermost segment 72*a* of feed finger 72. A third modification comprises locating the forward surfaces 72*d* and 72*e* of finger segments 72*b* and 72*c*, respectively, inwardly (or to the right as viewed in FIG. 9) with respect to the forward surface 72*f* of finger segment 72*a*. This inset is clearly illustrated in FIG. 12. Surfaces 72*d* and 72*e* are inset with respect to surface 72*f* by a distance equal to at least about one-half the diameter of collating wires 22 and 23.

The second and third modifications, just described, assist in preventing the head of the forwardmost nail from hitting and severing or nicking the wire segments formed on the second nail of the coil, when the first nail is driven into the workpiece by the tool driver. These three modifications of the feed pawl 56 greatly improve the performance of tool 1. Finally, it will be noted from FIGS. 9, 12 and 13 that the rearward surface 80 of discontinuous feed finger 73 slopes rearwardly and outwardly. During shifting of feed pawl 56 through its rearward or retracted position, the surface 80 cooperates with that nail of coil 14 adjacent the nail located between feed fingers 72 and 73 to cam the feed pawl out of engagement with the nails of coil 14 and into the guide body windows 42 and 43 so that the feed fingers can shift rearwardly to engage the next succeeding nail.

The structure of tool 1 is completed by door 7 of guide body 6. Door 7 (shown in FIGS. 4 and 5) is provided with hinge elements 81 and 82 which pivot about hinge pin 83 mounted in lateral elements 84 and 85 of guide body 6.

The exterior surface of guide body door 7 is provided with a cylindrical member 86 having a closed bottom end. The cylindrical member 86 contains a compression spring 87 and an elongated plunger 88 which terminates at its upper end in a nose 89. The plunger 88 has a laterally extending handle 90 which extends through a slot 91 in cylindrical member 86. The cylindrical member 86 has a pair of integral flanges 92 and 93 which support a transverse stop bar 94. The stop bar is normally abutted by laterally extending plunger handle 90, thus determining the uppermost position of plunger 88.

When guide body door 7 is in its closed position, the nose portion 89 of plunger 88 engages a perforation 95 in a flange 96 which extends laterally from the wall portion 32 of guide body 6 (see FIGS. 1 and 5). As is most clearly seen in FIG. 5, the flange 96 is provided with a lead-in surface 97. When the guide body door 7 is shifted to its closed position, the lead-in surface 97 will cam or shift nose 89 downwardly until the nose is free to enter flange perforation 95, under the influence of compression spring 87. To open the door, it is only necessary to depress the plunger handle 90 and swing the door to its open position.

The guide body door 7 also carries, near its forward end, a spring biased plunger 98. Reference is now made to FIG. 5, wherein the inside surface of guide body door 7 is shown. The plunger 98 carries a detent 99. The detent 99 has a forward surface 100 which is substantially perpendicular to the inside surface of guide body door 7. The remainder of detent 99 comprises a surface 101 which slopes rearwardly toward the inside surface of guide body door 7.

When the guide body door 7 is closed, it forms with the guide body wall 32 a narrow channel through which the nails of the coil pass on their way to drive track 31. The door 7 assures that the second nail of coil 14 remains engaged by feed pawl feed teeth 72 and 73. The detent 99 serves two purposes. First of all, it constitutes the missing segment of feeder tooth 73, and when the guide body door 7 is in its closed position, detent 99 will lie opposite the flat surface 102 of feed pawl 56, shown in FIGS. 9 and 13. When guide body door 7 is closed, detent surface 100 lies adjacent the second nail of the coil. When feed pawl 56 is shifted from its forwardmost to its retracted position, detent 99 and its surface 100 prevent the nails of the coil from shifting rearwardly. When feed pawl 56 is shifted from its retracted to its forwardmost position, the adjacent nail will cooperate with the surface 101 of detent 99 to cam the spring biased detent to its depressed position out of the way. As soon as the shifting nail achieves a position past detent surface 100, the spring biased detent will snap back to its normal, extended position.

Figure 14:
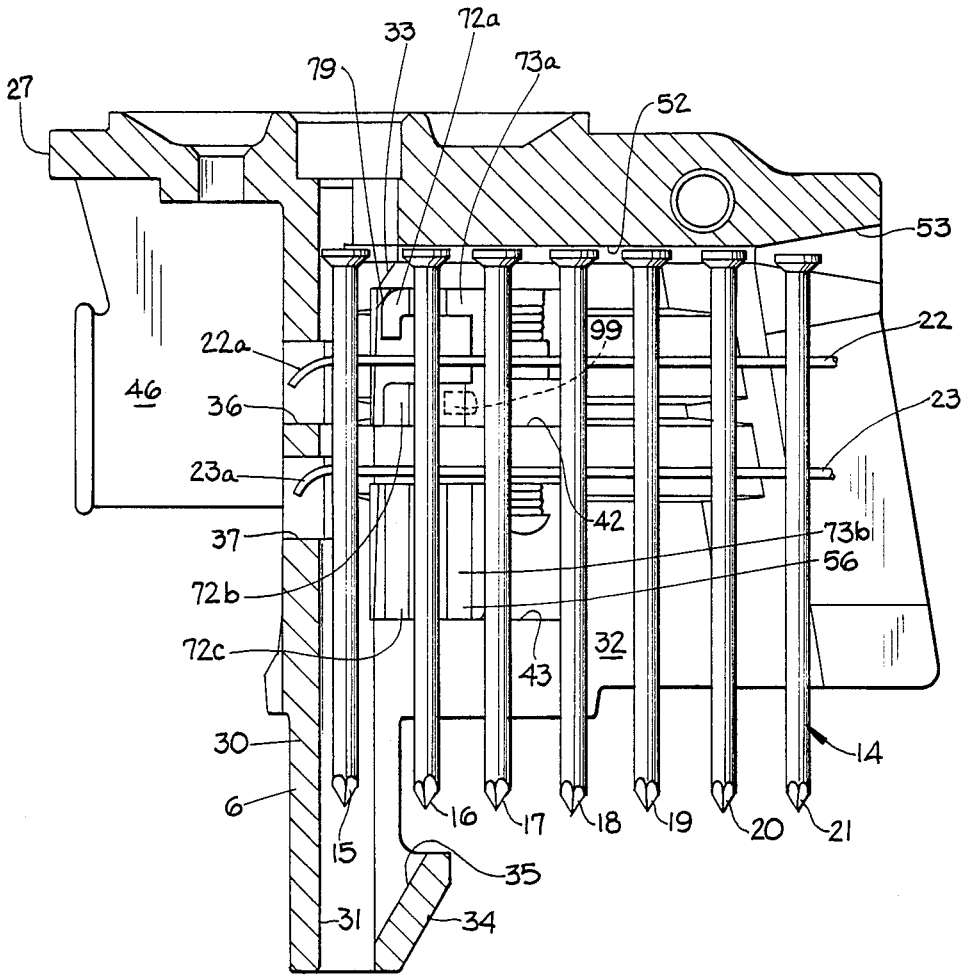
FIG. 14 is a cross sectional view of the guide body, similar to FIG. 7, and illustrating a portion of the strip or coil of nails therein, with the feeder pawl in its forwardmost position.

The invention having been described in detail, its operation can now be set forth. Reference is made to FIG. 14, wherein like parts have been given like index numerals.

The unrolled end of the coil of nails 14 is shown in place with the nail heads received in slot 52. The feed pawl feed teeth segments 72*a*, 72*b*, 72*c*, 73*a* and 73*b* engage the second nail 16 of the row. The feed pawl is shown in its forwardmost position, having introduced the forwardmost nail 15 into drive track 31. The forwardmost nail 15 is maintained in the position shown by collating wires 22 and 23. The wire segments 22*a* and 23*a* are shown, having entered bending windows 36 and 37. The guide body door detent 99 is shown in broken lines adjacent nail 16 and in position to prevent rearward movement (movement to the right as viewed in FIG. 14) of nail coil 14. With the various elements in the positions shown in FIG. 14, the tool is ready to initiate its driving cycle.

Figure 15:
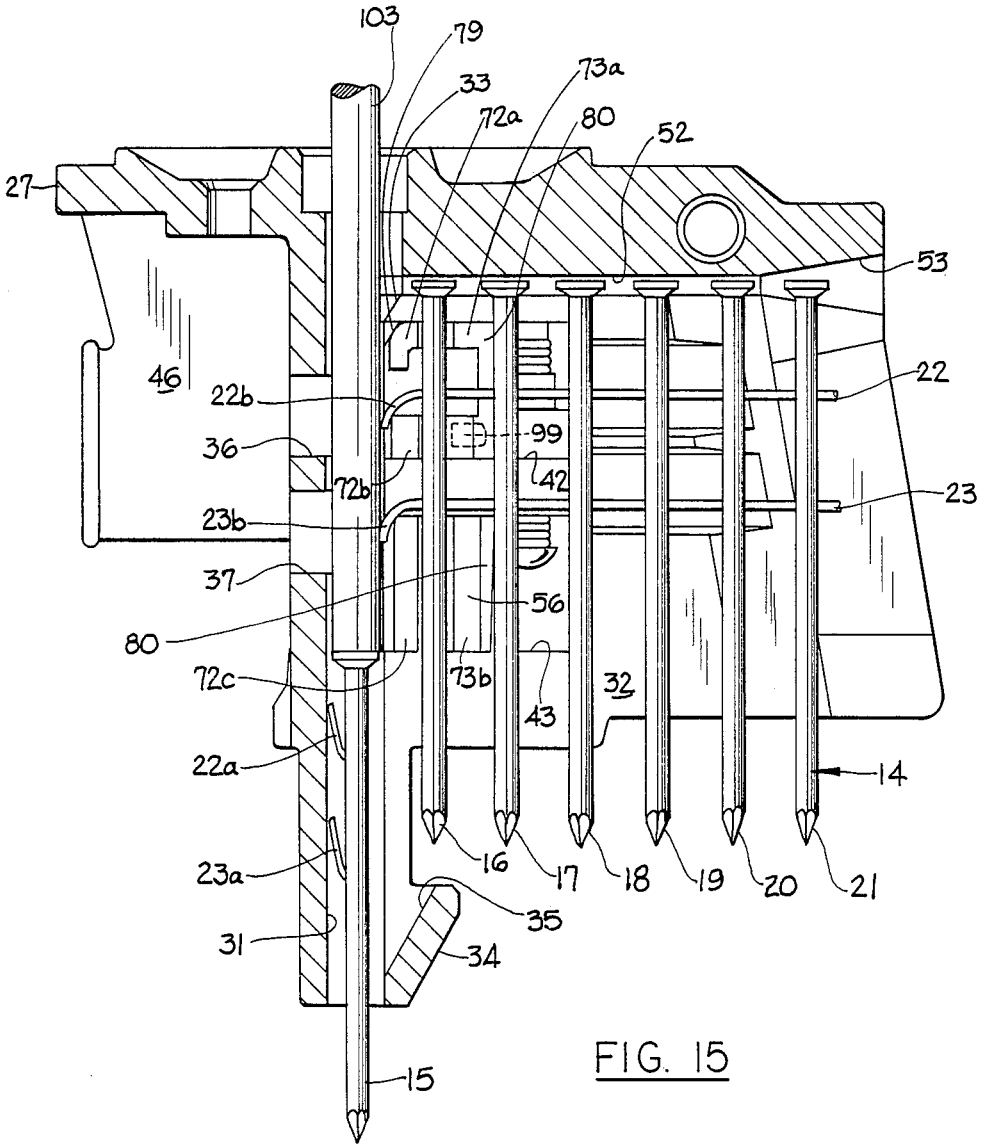
FIG. 15 is a cross sectional view of the guide body, similar to FIG. 14 and illustrating the forwardmost nail being driven downwardly by the driver after severance from the collating wires.

As indicated above, the driving cycle is initiated by depression of the workpiece responsive safety 13 against the workpiece and actuation of tool manual trigger 5. FIG. 15 is similar to FIG. 14 and illustrates the tool driver 103 during its driving stroke, having severed the forwardmost nail 15 from collating wires 22 and 23. Again, like parts have been given like index numerals.

It will be noted from FIG. 15 that wire segments 22*a* and 23*a* on forwardmost nail 15 have been bent upwardly along the shank of the nail by the lower edges of bending windows 36 and 37. Further, the widened feed pawl feed finger segments 72*b*, 72*c* and 73*b* give support to the collating wires 22 and 23 assuring that they break adjacent forwardmost nail 15. In addition, newly formed wire segments 22*b* and 23*b* on nail 16 are supported by the widened feed fingers so as to be properly oriented to enter windows 36 and 37 when nail 16 is shifted into drive track 31. The chamfer 79 applied to feed finger segment 72*a* and the insetting of the forward edges 72*d* and 72*e* of feed finger segments 72*b* and 72*c*, respectively, assures that the segments 22*b* and 23*b* are not hit and severed or nicked by the head of forwardmost nail 15 during the driving procedure.

Minimizing the width of slot 38 (see FIG. 5), through which forwardmost nail 15 passed to enter drive track 31, assures that the head of forwardmost nail 15 is captured in drive track 31 and cannot advance to the rear enough to contact segments 22*b* and 23*b*. These improvements have also minimized the possibilities for rearward angling of the nail point onto deflection surface 35, which causes the point to be rapidly shifted forwardly, and which in turn, causes the nail head to flip toward the rear of the drive track. Thus, the chances of the nail head hitting the newly formed wire segments 22*b* and 23*b* are substantially eliminated.

Once the driver 103 has completed its drive stroke and has finished so much of its return stroke as to clear drive track 31, the feeder pawl 56 will be actuated by cylinder 46 and shifted to its rearward position It will be appreciated that when the feed pawl 56 is shifted rearwardly, its cam surface 80 will cooperate with nail 17, causing feed pawl 56 to pivot outwardly about pin 76 so that feed finger segments 73*a* and 73*b* clear nail 17. At the end of its rearward stroke, the feed pawl will be so positioned that its feed fingers 72 and 73 lie to either side of and engage nail 17. During this rearward movement of feed pawl 56, the coil of nails has remained stationary under the influence of detent 99 mounted on the guide body door. At the end of its rearward stroke, the feed pawl is again moved forwardly by cylinder 47. This will shift nail 16 into drive track 31 ready to be driven. As explained above, detent 99 on the guide body door will permit forward movement of the nails, but not rearward movement.

Figure 16:
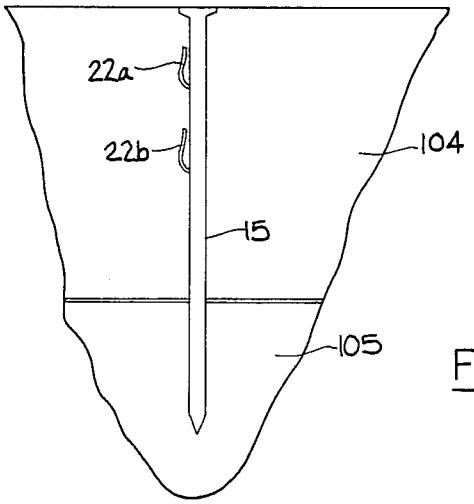
FIG. 16 is a fragmentary cross sectional view showing the forwardmost nail of FIG. 15 fully driven into a pair of wooden work pieces.

FIG. 16 illustrates the forwardmost nail 15 driven into a pair of wooden workpieces 104 and 105. It will be noted that wire segments 22a and 22b are bent upwardly along the shank of nail 15 and have been driven into the wood along with the nail shank. The bending of wire segments 22a and 23a by windows 36 and 37 occurs early in the nail driving procedure when the nail velocity is far less than when the nail segments reach the surface of workpiece 104.

In the description above, such words as "vertical", "horizontal", "upper", "lower", "forwardly", and "rearwardly", are used in conjunction with the drawings for purposes of clarity of description. It will be understood by one skilled in the art that, in use, tool 1 can be held in any orientation required.

Modifications may be made in the invention without departing from the spirit of it.

What is claimed is:

1. In a tool for driving a nail into a workpiece, said tool having a driver shiftable through a work stroke and a return stroke, a guide body defining a drive track for said driver, a magazine, a coil of nails in said magazine, said nails of said coil having shanks arranged and maintained in parallel, spaced, side-by-side relationship by a pair of collating wires welded to each nail shank, and a feed pawl having a pair of feed teeth thereon and being slidably mounted on said guide body and shiftable between a retracted position wherein said pair of feed teeth are located at and engage either side of the second nail of said coil and a forward position wherein the forwardmost nail of said coil is introduced into said drive track, each nail of said coil, as it becomes the second nail of said coil, having forwardly and downwardly extending segments of said collating wires formed on its shank when the forwardmost nail is driven by said driver during said work stroke and said collating wires are broken adjacent thereto, the improvement comprising means to bend said wire segments of each nail when it becomes the forwardmost nail of said coil upwardly along the shank of their respective nail during the initial portion of said drive stroke of said driver, whereby said wire segments of each nail remain affixed to the nail shank and are embedded therewith in said workpiece.

2. The tool claimed in claim 1 including means to support said wire segments of said second nail of said coil when said segments are broken from said forwardmost nail during driving thereof and to align said wire segments for cooperation with said segment bending means when said second nail of said coil becomes said forwardmost nail thereof and is introduced into said drive track.

3. The tool claimed in claim 2 wherein said pair of feed teeth of said feed pawl comprise first and second teeth, said first feed tooth comprising aligned upper, intermediate and lower segments lying adjacent the shank of said second nail between said forwardmost nail and said second nail, said second tooth comprising aligned upper and lower segments lying adjacent said shank of said second nail between the second and third nail of said coil, said intermediate and lower segments of said first tooth being of such width as to support and align said wire segments of said second nail for cooperation with said bending means when said second nail becomes said forwardmost nail and is shifted into said drive track.

4. The tool claimed in claim 1 including means to prevent the head of the forwardmost nail from hitting said wire segments of said second nail and breaking or nicking them.

5. The tool claimed in claim 4 wherein said pair of feed teeth of said feed pawl comprise first and second teeth, said first feed tooth comprising aligned upper, intermediate and lower segments lying adjacent the shank of said second nail between said forwardmost nail and said second nail, said second tooth comprising aligned upper and lower segments lying adjacent said shank of said second nail between the second and third nail of said coil, said upper, intermediate and lower segments of said first tooth having leading edges facing said drive track, said leading edges of said intermediate and lower segments being inset with respect to the leading edge of said upper segment and said upper segment having a chamfer formed thereon, whereby to prevent the head of the forwardmost nail from hitting and breaking or nicking said wire segment of said second nail during said drive stroke of said driver.

6. The tool claimed in claim 4 including a slot formed in said guide body leading to said drive track through which said forwardmost nail is inserted by said feed pawl into said drive track, said slot having an enlarged portion at its upper end to accomodate the head of said forwardmost nail, the remainder of said slot being of such width as to just nicely permit said shank of said forwardmost nail to pass therethrough, whereby to minimize rearward movement in said drive track of said head of said forwardmost nail to prevent said head from hitting and breaking or nicking said wire segments of said second nail during said drive stroke of said driver.

7. The tool claimed in claim 1 wherein said nail shanks are spaced along said collating wires by a distance assuring the formation of wire segments of sufficient length to cooperate with said wire segment bending means.

8. The tool claimed in claim 1 wherein said wire segment bending means comprises a pair of windows formed in the forward portion of said drive track and aligned to receive said wire segments when the forwardmost nail of said coil is shifted into said drive track, said windows having lower surfaces positioned to engage and bend said: wire segments during the initial part of said drive stroke.

9. The tool claimed in claim 8 wherein said pair of feed teeth of said feed pawl comprise first and second teeth, said first feed tooth comprising aligned upper, intermediate and lower segments lying adjacent the shank of said second nail between said forwardmost nail and said second nail, said second tooth comprising aligned upper and lower segments lying adjacent said shank of said second nail between the second and third nail of said coil, said intermediate and lower segments of said first tooth being of such width as to support and align said wire segments of said second nail for =cooperation with said bending means when said second nail becomes said forwardmost nail and is shifted into said drive track.

10. The tool claimed in claim 9 wherein said upper, intermediate, and lower segments of said first tooth have leading edges facing said drive track, said leading edges of said intermediate and lower segments being inset with respect to the leading edge of said upper segment and said upper segment having a chamfer formed thereon, whereby to prevent the head of the forwardmost nail from hitting and breaking or nicking said wire segment of said second nail during said drive stroke of said driver.

11. The tool claimed in claim 10 including a slot formed in said guide body leading to said drive track through which said forwardmost nail is inserted by said feed pawl into said drive track, said slot having an enlarged portion at its upper end to accomodate the head of said forwardmost nail, the remainder of said slot being of such width as to just nicely permit said shank of said forwardmost nail to pass therethrough, whereby to minimize rearward movement in said drive track of said head of said forwardmost nail to prevent said head from hitting and breaking or nicking said wire segments of said second nail during said drive stroke of said driver.

12. The tool claimed in claim 11 wherein said nail shanks are spaced along said collating wires by a distance assuring the formation of wire segments of sufficient length to cooperate with said wire segment bending means.

* * * * *